US005787618A

United States Patent [19]

Mullis

[11] Patent Number: 5,787,618

[45] Date of Patent: Aug. 4, 1998

[54] DISPLAY APPARATUS THAT FORMS AN OPTICAL ILLUSION

[76] Inventor: Randy J. Mullis, 1042 W. Navajo Rd., Tucson, Ariz. 85705

[21] Appl. No.: 641,348

[22] Filed: May 1, 1996

Related U.S. Application Data

[63] Continuation-in-part of Ser. No. 608,600, Feb. 29, 1996.

[51] Int. Cl.[6] ..... G09F 13/12

[52] U.S. Cl. ..... 40/219; 40/546; 40/581; 472/63

[58] Field of Search ..... 40/219, 427, 546, 40/714, 900, 581; 472/58, 63

[56] References Cited

U.S. PATENT DOCUMENTS

| | | | |
|---|---|---|---|
| 2,042,268 | 5/1936 | Michaus | 472/63 X |
| 2,286,246 | 6/1942 | Yearta | 40/219 |
| 3,605,303 | 9/1971 | Reichow | 40/546 X |
| 4,139,955 | 2/1979 | Reiback . | |
| 4,157,625 | 6/1979 | Bowser . | |
| 4,164,823 | 8/1979 | Marsico . | |
| 4,791,745 | 12/1988 | Pohn | 40/546 |
| 5,215,285 | 6/1993 | Lewis | 40/546 X |

FOREIGN PATENT DOCUMENTS

| | | | |
|---|---|---|---|
| 2029067 | 3/1980 | United Kingdom | 40/219 |

*Primary Examiner*—Brian K. Green
*Attorney, Agent, or Firm*—Franklin Gubernick

[57] ABSTRACT

A display device having an interior area in which multiple images are displayed. The images arise from reflections of one or more externally or internally illuminated patterns located within the apparatus. The device creates an optical illusion whereby multiple images appear to extend a rearward distance that is greater than the thickness of the apparatus. When multiple patterns are employed, the patterns may be spaced from each other and are combined to form the desired image. The apparatus may include one or more spotlights that function to highlight predetermined area(s) within the device. The apparatus may alternatively or in combination employ an isolated light source that illuminates the interior of a light transmitting object located between the reflective surfaces to thereby cause the object and especially the object's side edges to glow with light. In addition, recessed lighting fixtures may be employed to illuminate the interior area of the device in a manner whereby the lighting fixtures are not readily viewable from a location exterior to the device.

18 Claims, 4 Drawing Sheets

DISPLAY APPARATUS THAT FORMS AN OPTICAL ILLUSION

This application is a Continuation-In-Part of application Ser. No. 08/608,600 filed Feb. 29, 1996.

FIELD OF THE INVENTION

The invention is in the field of display units that create an optical illusion. More particularly, the invention is an apparatus that employs multiple reflective surfaces to internally create an optical illusion. The invention includes one or more patterns that are uniquely lighted, highlighted and/or merged to create a unified image. A viewer looking into the front of the apparatus will see what appears to be an infinitely repeated image of the pattern(s). A three-dimensional image is usually produced. In an alternate embodiment of the invention, a translucent or transparent member that is internally illuminated by a hidden light source is located between the reflective surfaces. The light issuing from the member is then employed to create multiple images of the member and/or the member's side edges.

BACKGROUND OF THE INVENTION

There are a number of devices in the prior art that create the optical illusion of an endless tunnel within a display apparatus. Representative of these teachings is a patent issued to Reibeck (U.S. Pat. No. 4,139,955).

Reibeck teaches a cabinet having a front-located one-way mirror and a rear-located conventional mirror. The reflective surfaces of the mirrors face each other and there is a substantially open area located between the mirrors. The open area is broadly illuminated by a light source. The light source consists of a plurality of incandescent light bulbs located about the interior periphery of the cabinet and extend into the viewing area between the mirrors. A person looking through the one-way mirror will see what appears to be an endless tunnel. The walls of the tunnel, except for their extreme front portions, are a virtual image consisting of multiple reflections of the interior side surfaces of the cabinet. The incandescent bulbs help to define the walls of the tunnel and provide reference points along the tunnel's length.

In addition to the basic teaching provided by Reibeck, other modifications are taught in the prior art in which the appearance of the virtual tunnel is altered or additional images are created within the tunnel. For example, it is taught that if one orients the rear mirror at an angle to the front mirror, the virtual tunnel will appear to bend to one side or another dependent on the angle of the rear mirror. Other modifications taught in the prior art include using different shapes of mirrors, placing items between the mirrors and partially removing predetermined portions of the one-way mirror's reflective surface.

While the basic optical illusion of an endless tunnel is a fascinating and unusual effect, the prior art devices substantially ignored the central area of the tunnel. There was no attempt to create a unified image through a compilation of reflected images. In addition, the prior art did not try to create unusual virtual images through the use of different types of lighting, by employing multiple and varied surface patterns or by internally illuminating an interior member using a hidden light source.

SUMMARY OF THE INVENTION

The invention is an apparatus that internally creates an optical illusion that is viewable from an exterior location.

One or more patterns are located within the apparatus and are displayed and/or merged in the unit's viewing area and seemingly repeated into the rearward distance. To achieve the desired effects, the unit displays the pattern(s) in a unique manner. Special types of lighting and the use of an internally-illuminated member may also be employed.

The one or more patterns located within the apparatus may be in the form of one or more distinctively-shaped discrete members and/or organized sets of markings placed onto one of the apparatus' interior surfaces. It should be noted that when a pattern consists of a rigid member, the member itself can have different patterns located on its front and rear surfaces. These patterns, as well as the member's shape, will all be employed in creating the image provided by the apparatus. When multiple patterns are employed, a viewer looking into the front of the device will see the different patterns merged together to form a unified three-dimensional image in which at least a portion of said image will seemingly be repeated into the rearward distance.

In a first embodiment of the invention, a pattern in the form of a distinctively-shaped member is affixed to the interior surface of the device's front-located one-way mirror. The member preferably has different markings/patterns of markings located on its front and rear surfaces. By placing the member against the one-way mirror, a reflection of the front of the member will not be created. A person looking at the front of the apparatus will see an image that includes both real and virtual portions. The real portion of the image is derived from the person's direct viewing of the front surface of the member. The virtual portion of the image is composed of the reflected images of the rear surface of the member created by light bouncing between the apparatus' front- and rear-located mirrors. It should be noted that since the markings located on the rear surface of the member cannot be seen directly by the viewer, they are only viewable as a reflection or virtual image. In this manner, the virtual and real images are combined to create a complex three-dimensional image.

In a second embodiment of the invention, the apparatus includes at least one spotlight adapted to shine a tightly-focused beam of light onto a predetermined location between the apparatus' two reflective surfaces. The spotlight may used as the sole illuminating source within the device or it may be used in conjunction with a second light source that broadly and diffusely illuminates the area between the device's two reflective surfaces. In the preferred embodiment, the spotlight is directed at a pattern located on one of the device's reflective surfaces, or on a separate pattern member located between the reflective surfaces. If more than one spotlight is employed, the spotlights can be aimed at different areas of the same pattern or, if there are multiple patterns located within the device, on different ones of said patterns. The function of the spotlight is to highlight a portion of the pattern and thereby accentuate the image of said portion throughout the multiple virtual images/reflections created within the apparatus. Furthermore, since the number of virtual images created within the apparatus is directly dependent on the degree to which the pattern or area is illuminated, the use of spotlights to highlight one or more areas increases the number of virtual images of the highlighted area(s) that will be created. In this manner, the highlighted pattern or portion thereof will seemingly extend further into the distance than will non-highlighted regions within the apparatus.

The invention also teaches the use of recessed lighting. By recessing the lighting fixtures, they are not readily viewable through the one-way mirror. In this manner, the images of the pattern or patterns is emphasized while the illusion of tunnel walls is minimized.

In a third embodiment of the invention, the pattern is in the form of a transparent or translucent member that is located between the front and rear reflective surfaces of the device. In the preferred embodiment, the member is made of an acrylic plastic material and has sharply defined side edges. The bottom of the member protrudes into a chamber that houses a light source. The light source is preferably isolated from the open area between the reflective surfaces. In operation, the light source illuminates the end portion of the member. The light then travels through the interior of the member and thereby causes the body and especially the side edges of the member to glow with light. The degree to which the body of the member will glow with light is inversely proportional to the transparency of the member. In most cases, the side edges of the member will be strongly illuminated since most of the light will exit from the member at the member's edges. In this manner, the edges of the member will issue a significant amount of light and thereby create a highly defined outline of the member. This brightly glowing outline is then strongly reproduced in the images created within the device as the light is reflected back and fourth between the device's two reflective surfaces.

DETAILED DESCRIPTION OF THE DRAWINGS

Figure 1:
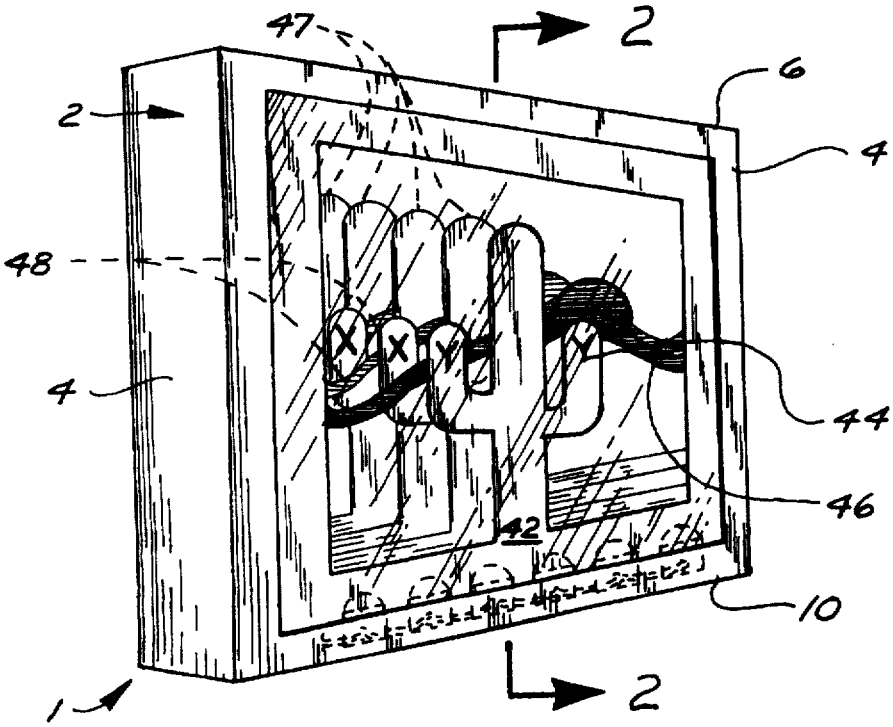
FIG. 1 is a front perspective view of a first embodiment of a display apparatus in accordance with the invention.

Referring now to the drawings in greater detail, wherein like characters refer to like parts throughout the several figures, there is shown by the numeral 1 a display apparatus in accordance with the invention.

The apparatus includes a housing 2 having side portions 4, a top portion 6 and a bottom portion 10. In the preferred embodiment, portions 4, 6 and 10 are made of wood. Alternatively, other rigid materials such as plastic or metal may be employed for the housing portions. The housing has length and height dimensions similar to those of a conventional picture frame. The thickness of the housing is typically in the range of from one to twelve inches. Even thicker housings may sometimes be employed.

Located at the front of the apparatus and secured to said housing is a planar one-way mirror 12. A one-way mirror is herein defined as a member that is substantially transparent when viewed from a location exterior to the housing while at the same time functioning as a mirror to at least partially reflect light impinging on it from within the apparatus. The mirror 12 has front and rear surfaces, 14 and 16, respectively. It should be noted that mirror 12 is of the same type as described for the front mirror in the device taught in the Reibeck patent.

Located at the rear of the apparatus is a conventional mirror 18. The mirror is oriented so that its reflective surface 20 faces toward the front of the apparatus. Planar member 21 is located behind mirror 18 and forms the back surface of the housing. Alternatively, but not shown, the back surface 22 of mirror 18 may form the back of the housing.

As can be seen in the drawings, the apparatus includes an interior area 24 located between the one-way mirror 12 and mirror 18. Since this area is substantially open and located between the two reflective members 12 and 18, light can travel through this area and bounce back and fourth between the reflective members.

In a first embodiment of the invention, there is disposed within the housing a light source 26. The light source is located whereby it can illuminate area 24. In the preferred embodiment, the light source is in the form of a plurality of low voltage light bulbs 28 that are located in a recessed manner within the interior periphery of the housing. By recessing the bulbs, they are not readily viewable to a person looking through mirror 12 and thereby the optical illusion created within the apparatus will not include images/reflections of the bulbs.

Alternatively, the bulbs 28 can extend into the portion of area 24 viewable through mirror 12 whereby their image will be reflected and become part of the virtual images created within the apparatus. In the embodiment shown in FIG. 1, the bulbs are located only in the bottom portion 10 of the housing. Alternatively, the bulbs may be placed in other portions of the housing and may fully encircle the inner perimeter of the housing. When the light bulbs and the housing's interior walls are readily viewable through one-way mirror 12, a person looking through the one-way mirror from a location in front of the apparatus will see what appears to be an endless tunnel whose sides are defined by the interior walls of the housing and the light bulbs and virtual images of said walls and bulbs.

The bulbs 28 are wired in series and are connected to a source of electricity (not shown) by a standard electrical cord 30. While not shown, an electrical transformer may also be employed. The electrical cord 30 preferably includes a switch 32 that enables a person to control the flow of electricity to the bulbs.

Figure 2:
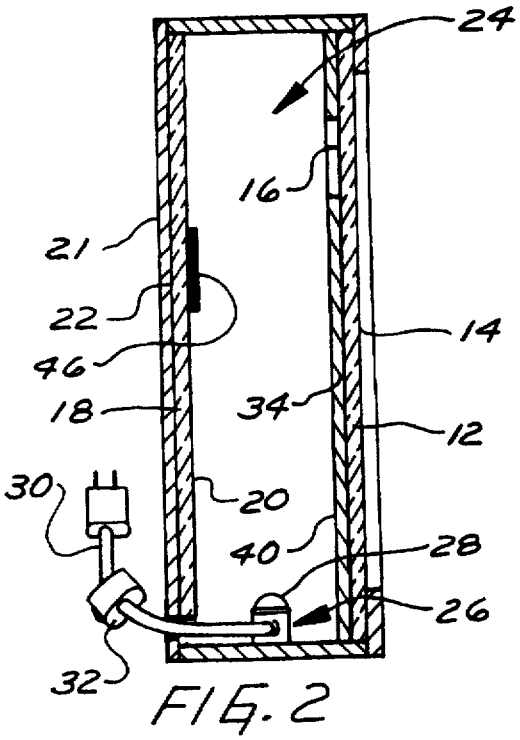
FIG. 2 is a cross-sectional side view of the display apparatus shown in FIG. 1. The view is taken along the plane labeled 2—2 in FIG. 1.

As can be seen in FIGS. 1 and 2, the rear surface 16 of mirror 12 has a pattern member 34 affixed thereon. The pattern member may be a rigid or flexible member such as a thin piece of shaped wood, a plastic applique or even a piece of cardboard. In the embodiment shown, the pattern member is a shaped piece of wood. The pattern member is cut so that its defines a desired shape, such as the saguaro cactus shown. In the embodiment shown, the pattern member is also shaped so that it forms a rectangular frame around the cactus form.

Figure 3:
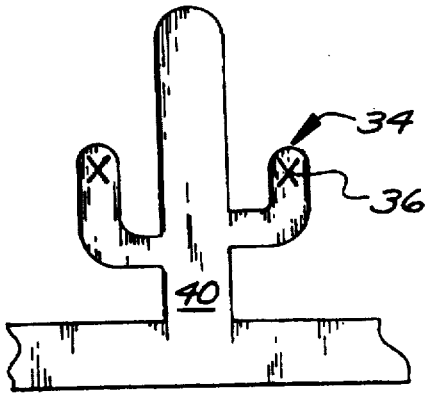
FIG. 3 is a rear view of a portion of the front-located pattern shown in FIG. 1.

As shown in FIG. 3, pattern member 34 has distinctive markings 36 on its rear-facing surface 40. These markings, in the form of "X"'s, cannot be directly seen from the front of the apparatus but are only viewable through mirror 12 as a reflection off the mirror 18. As also shown in the drawings, the front surface 42 of pattern member 34 has distinctive markings 44 in the form of "Y"'s. Since markings 44 are on the front surface of the pattern member and the pattern member is in direct contact with the mirror 12, there can be no reflection of the markings 44 back toward the rear of the apparatus. In this manner, markings 44 are only visible from the front of the device and are not shown in any of the reflected images created within the apparatus. Therefore, a single pattern member may provide two distinctly different patterns.

Located on the front surface 20 of mirror 18 is a pattern 46 that is preferably different from pattern member 34. In the embodiment shown, pattern 46 is a painted image of a sky having a plurality of clouds and a sun. In FIG. 2, the thickness of pattern 46 has been exaggerated for viewing ease.

The pattern 46 may be an applique or be created using paint or a similar material that is applied to the surface 46 of mirror 18 using a brush or other conventional means for applying a mark to a surface. Alternatively but not shown, a shaped pattern member may be affixed to the front surface of mirror 18. The pattern member may be in addition to or in lieu of the affixed/painted pattern 48 shown.

In the embodiment of the invention shown in FIG. 1, there is also shown a virtual image in the form of reflections 47 and 48 of patterns 34 and 46 respectively. While only two reflections are shown, a person looking into the front of the apparatus would see a large number of reflections that seem to be repeated into infinity. Unlike prior art devices, the invention merges the different patterns and reflections into a single image or picture. In this manner, the image/picture includes both virtual portions (reflected images) and real portions (direct viewing of the front surface of the patterns and/or pattern members 34 and 46) to provide a unique representation of a desired cumulative image. It should be noted that the merging of the reflections gives the created image a three-dimensional appearance as, for example, the reflection of the back surface of the cactus appears to be located behind the clouds and also appears to be a different cactus from the one located in front of the clouds.

Figure 4:
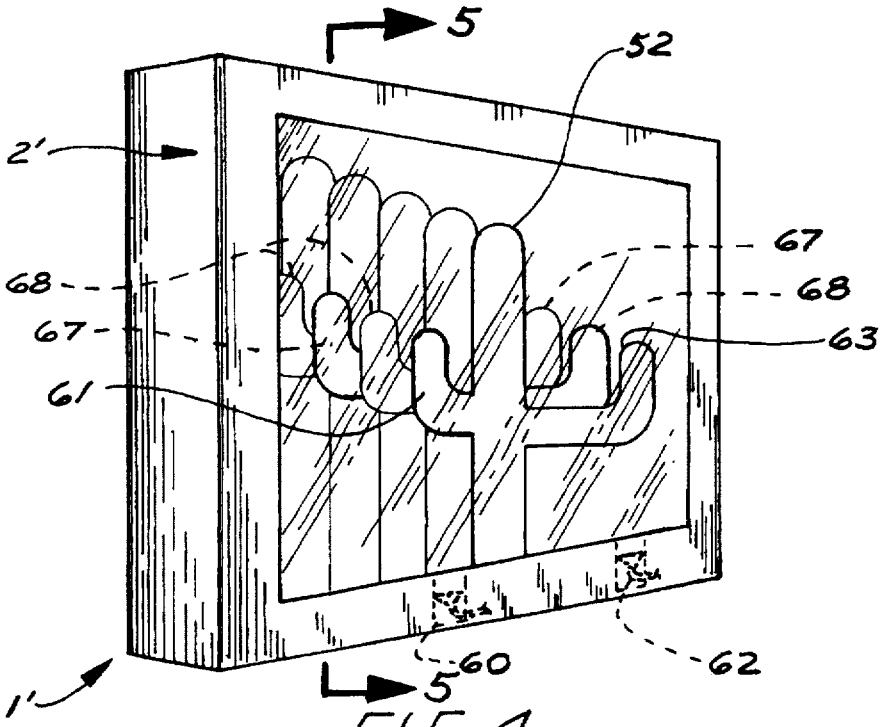
FIG. 4 is a front perspective view of a second embodiment of a display apparatus in accordance with the invention.
Figure 5:
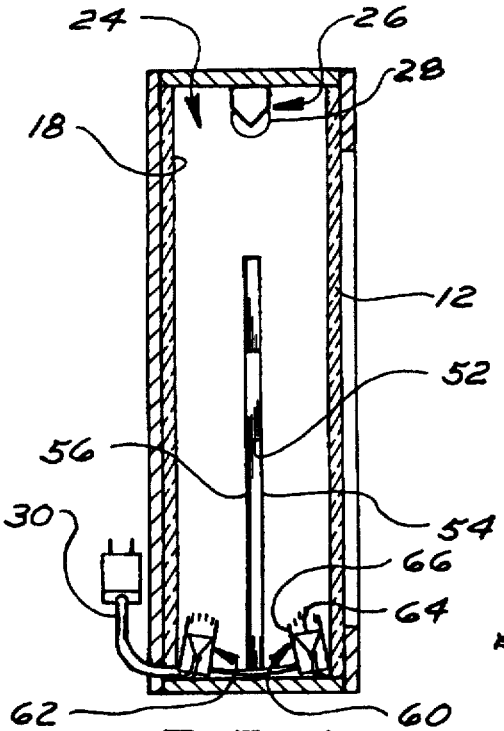
FIG. 5 is a cross-sectional side view of the display apparatus shown in FIG. 4. The view is taken along the plane labeled 5—5 in FIG. 4.

FIGS. 4 and 5 show a second embodiment of a display apparatus 1' in accordance with the invention. As in the first embodiment, apparatus 1' includes a housing 2 having a front-located one-way mirror 12, a rear-located mirror 18 and an area 24 located between the two mirrors. A recessed light source 26 comprising a fluorescent lamp 28 is employed to illuminate area 24. The bulb is connected through conventional means to a source of power via electrical cord 30. As in the first embodiment, the reflective surfaces of mirrors 12 and 18 face each other whereby light can pass through area 24 and be reflected back and fourth between said surfaces.

A first difference between this embodiment and the previously described embodiment is that there is a pattern member 52 disposed in the area 24 and spaced apart from both the one-way mirror 12 and the rear-located mirror 18. The pattern member may have distinctive markings on its front surface 54 as well as having distinctive markings located on its rear surface 56. Since the pattern member is disposed between the two reflective surfaces, any markings on either or both of the surfaces 54 and 56 will be reflected from the mirrors 12 and 18 and be viewable and combined in the virtual images created within the apparatus.

A second difference between embodiment 1' and embodiment 1 is in the lighting fixtures within the apparatus. In addition to light source 26, embodiment 1' includes spotlights 60 and 62 disposed adjacent the pattern member 52. Unlike the light source 26 that functions to provide diffuse illumination to the entire area 24, each spotlight provides a tightly-focused beam of light that shines on only a small, predetermined area. To accomplish this, each spotlight includes a high-intensity bulb 64 housed within an open-ended aiming tube 66 that has a solid sidewall. The bulb is connected to a source of electrical power via the electrical cord 30.

Each of the spotlights 60 and 62 is aimed to shine on a different area of the pattern member 52. In the apparatus shown in FIGS. 4 and 5, spotlight 60 is aimed at the front surface 54 of the pattern member and on the cactus' left arm 61 in particular. In the same figures, spotlight 62 is aimed at the back surface 56 of the pattern member and on the cactus' right arm 63 in particular. The spotlights cause the targeted areas of the pattern member to be highlighted relative to the other portions of the member. The reflected images of surface 54 are labeled 67 in FIG. 4 and the reflected images of surface 56 are labeled 68. It should be noted that the highlighted areas continue to appear in highlighted fashion throughout the virtual/reflected images created within the apparatus. In addition, it should be noted that each of the highlighted regions appear in every other reflection since the reflections sequentially alternate the front and rear surfaces of the pattern member(i.e.—the first reflection shows the back of the cactus, the second shows the front of the cactus, the third shows the back again, etc.). In addition, since the number of virtual images created within the apparatus is proportional to the intensity to which they are illuminated, the highlighted areas will seem to extend further into the distance than will other portions of the pattern member.

While two spotlights are shown, the apparatus 1' can employ only a single spotlight or a greater number of spotlights. The spotlight(s) can be aimed at other portions of the pattern member 52. As another alternative, multiple pattern members 52 may be placed within the device and they may be partially or wholly illuminated by one or more spotlights. Furthermore, but not shown, the spotlight(s) can be aimed at patterns or pattern members that are located on the device's reflective surfaces in a manner similar to those disclosed in the first embodiment of the invention.

Figure 6:
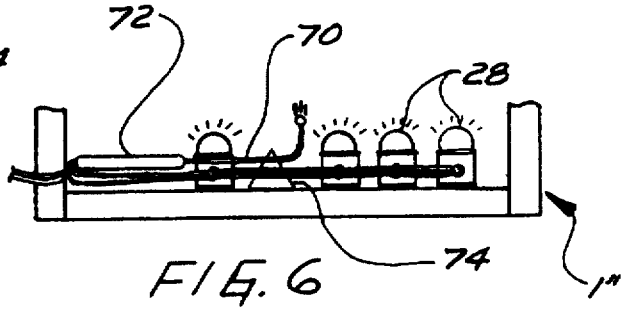
FIG. 6 is a front view of a bottom portion of a third embodiment of a display apparatus in accordance with the invention. The apparatus' mirrors are not shown.

It should also be noted that other types of spotlights may be used in lieu of the spotlights shown in FIGS. 4 and 5. For example, FIG. 6 shows the bottom portion of an apparatus 1" that is substantially identical to the apparatus shown in FIG. 1. The apparatus is shown with the mirrors and rear-located member 21 removed. The apparatus employs bulbs 28 to broadly illuminate area 24. In addition, the apparatus includes a spotlight in the form of an optical fiber 70 connected to a conventional high-intensity light source such as a laser 72. The fiber is secured to the housing 2 by a bracket 74. The end of the fiber is pointed at and preferably proximate the desired area to be illuminated. Actuation of the light source 72 causes the optical fiber to transmit light that is emitted from the end of the fiber in a tight beam to thereby highlight a predetermined localized area.

Figure 7:
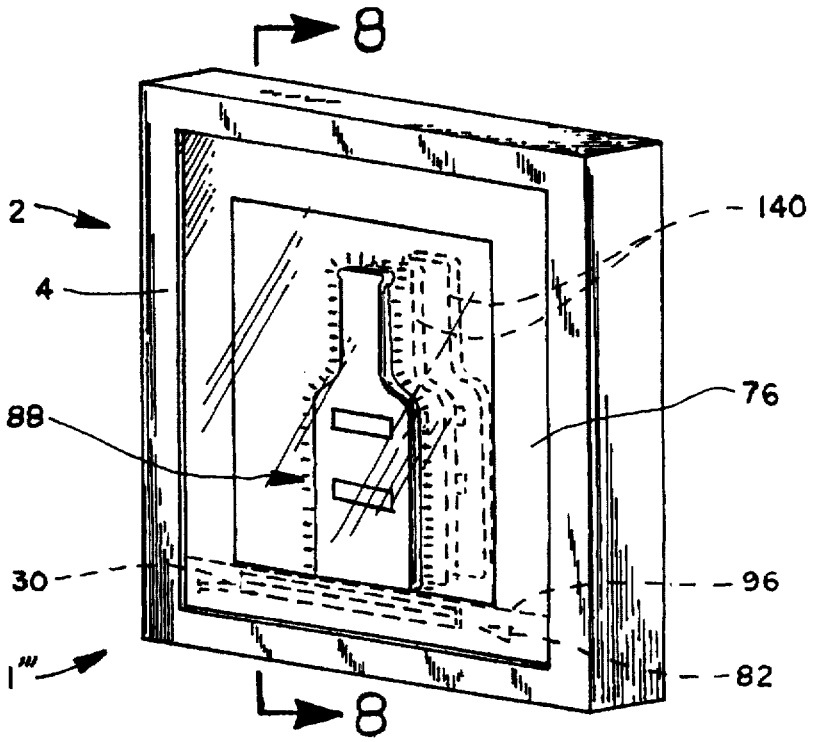
FIG. 7 is a perspective view of a third embodiment of a display apparatus in accordance with the invention. In this view, the light source is shown in phantom.
Figure 8:
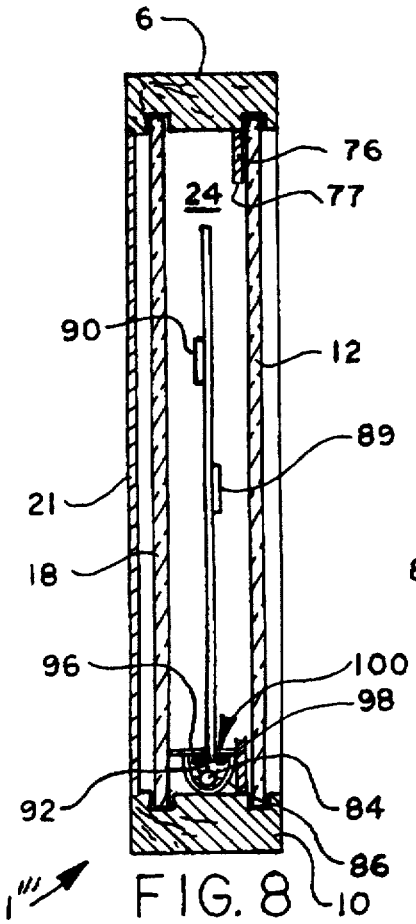
FIG. 8 is a cross-sectional elevational view of the apparatus shown in FIG. 7. The view is taken at the plane labeled 8—8 in FIG. 7.

FIGS. 7 and 8 show a third embodiment of a display apparatus 1''' in accordance with the invention. As in the first two embodiments, apparatus 1''' includes a housing 2 having a front-located one-way mirror 12, a rear-located mirror 18 and an area 24 located between the two mirrors. The housing structure surrounding the area 24 may optionally include a reflective coating. A rectangular frame 76 having a rectangular opening 77 abuts the inner surface of mirror 12. The frame may optionally include a reflective coating on its rearward facing surface. In this embodiment, a light source 82 is located beneath the area 24 and is isolated from said area whereby it does not directly light said area.

The light source 82 is in the form of a conventional fluorescent light fixture. The fixture's bulb 84 is connected to a source of power via an electrical cord 30. An optional tubular housing 86 made of a reflective material substantially surrounds the bulb. It should be noted that other well known sources of light, such as an incandescent bulb, can be employed in lieu of the fluorescent light shown.

As in the previous embodiments, light can pass through area 24 and be reflected back and fourth between the one-way mirror 12 and mirror 18. However, in this embodiment, there are no light bulbs or spotlights in area 24. Instead, there is an internally-illuminated member 88 situated between the reflective surfaces and issuing light into area 24. Member 88 is analogous to the patterns or pattern members of the previous embodiments in that it has a particular form that is illuminated and subsequently reproduced in the virtual images created within the apparatus.

Member 88 is preferably made of a substantially transparent material such as plastic or glass. A translucent, colored material may also be employed. In the preferred embodiment, member 88 is made of an acrylic plastic material and has a distinctive shape such as the bottle shown. In addition, the member may include distinct patterns, such as labels 89 and 90, located on its front and rear surfaces respectively. The added patterns are optional and may be made of a reflective material. Alternatively, patterns may be cut into the surface of the member and thereby become illuminated as light travels through the body of the member 88.

Figure 9:
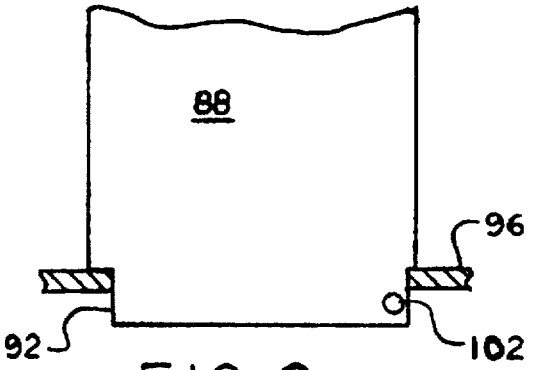
FIG. 9 is a front view of the bottom portion of the internally-illuminated member and some of the adjacent structure.

The member 88 has a reduced-width bottom-located portion 92 (note FIG. 9). The portion extends through a complementary-shaped aperture 94 in a planar support surface 96 that acts as a floor to area 24. As shown in FIG. 8, portion 92 is located directly above the bulb 84 and is illuminated by light from said bulb and by light reflected from the housing 86. It should be noted that while housing 86 is optional, it does maximize the light that will impinge on portion 92.

Figure 10:
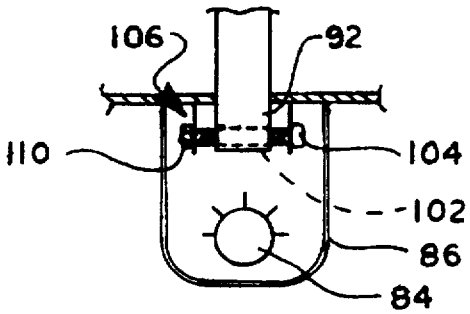
FIG. 10 is a side elevational view of the structure shown in FIG. 9 as well as one embodiment of the fastening structure used to secure the internally-illuminated member.

A fastening system 100 secures the member 80 to the housing via the housing-attached surface 96. System 100 may be in the form of a conventional adjustable securement such as a clamp 98 generically shown in FIG. 8. As shown in FIGS. 9 and 10, the system can alternatively employ an aperture 102 located in portion 92 and a fastener such as bolt 104. The bolt is removable and securement is achieved when the bolt extends through aperture 102 and also through apertures (not shown) in a complementary bracket assembly 106 that is secured to the housing via surface 96. At least one removable nut 110 is secured to the bolt to maintain the position of the bolt.

Figure 11:
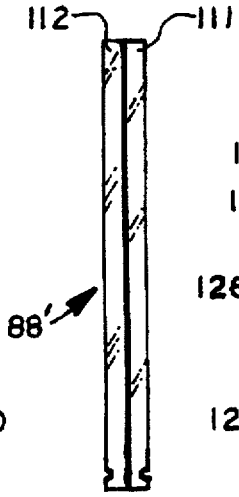
FIG. 11 is a cross-sectional view of an alternate embodiment of a member designed to be internally illuminated.
Figure 12:
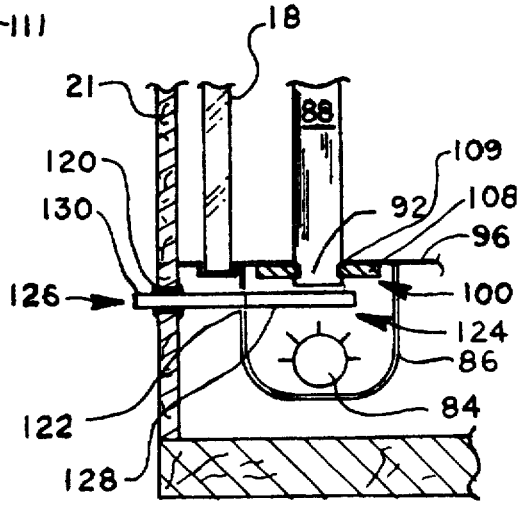
FIG. 12 is a cross-sectional elevational view of an alternate embodiment of the portion of the apparatus in the area of the light source.

FIGS. 11 and 12 show another method for releasably securing the member to the housing-attached surface 96. As shown, resilient elements 108 are secured to surface 96. The member 88 includes complementary notches 109 located on either the front and rear faces or the side edges of portion 92. The notches become releasably engaged to the resilient elements when the member is inserted through the aperture 94. While three methods of releasably securing the member 88 are shown, the fastening system 100 may employ other alternative fasteners such as spring clips or other quick-release fasteners to secure member 88 to the housing. It should be noted that the preferred fastening system employs releasable elements that allow a user to remove one member 88 and then replace it with another member 88 having a different shape. It should also be noted that the fit between the exterior of portion 92 and the interior of aperture 94 helps to secure the member 88 in the desired position and can be the sole component of system 100.

Figure 13:
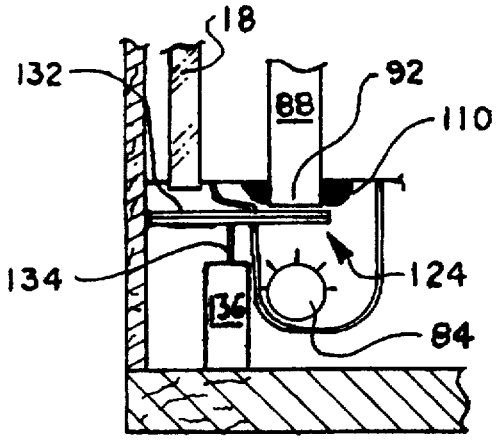
FIG. 13 is a cross-sectional elevational view of another alternate embodiment of the portion of the apparatus in the area of the light source.

Another alternative for fastening system 100 is to employ a substantially permanent fastener to secure the member 88 to the housing. For example, FIG. 13 shows an adhesive in the form of a mass 110 of glue or silicone caulking securing the member 88 to the underside of surface 96. Other permanent securement methods including mechanical fasteners such as nails, rivets or staples may also be employed. While a permanent securement for member 88 does not enable easy substitution of one shaped member 88 for another, it will perform the minimum functionality of securing the member in the desired location.

While a basic transparent member 88 has been discussed, it is within the venue of the invention that other light-transmitting members may be employed. For example, the member can be made of a translucent material such as a colored plastic. In this manner, the member will emit a colored glow when exposed from below to light from the light source. As another alternative, the member 88 can be a laminated structure, as shown in FIG. 11. When a laminated construction is employed, one layer, such as layer 111, can be either a translucent or transparent material and the other layer, such as layer 112, can also be either a translucent or transparent material. For example, layer 111 can be made of a blue translucent plastic and layer 112 can be made of a red translucent plastic. The resultant reflected images 140 of the member would then alternate in color.

FIG. 12 shows another embodiment of the portion of the display apparatus that houses the light source 82. The primary difference between this embodiment and the previously discussed embodiment is that the rear (or alternatively, a side portion) of the housing and also a portion of the reflector 86 include apertures 120 and 122 respectively. The apertures provide a user with a means to access the area 124 located between the bottom of the member 88 and the top of the bulb 84. In this manner, and as shown in the drawings, a user can insert a colored slide 126 into area 124 to thereby change the color of the light that will enter the bottom of member 88. This results in the member glowing with light of the same color as that of the slide 126. In the preferred embodiment, slide 126 consists primarily of a thin rectangular section 128 of colored plastic or glass. The slide preferably also includes a plastic end-located section 130 that acts as a handle structure for the slide. When a user has a plurality of slides 126 with each slide having a different colored portion 128, the user can change the color of light issuing from member 88 by merely withdrawing one slide 126 and replacing it with another of the slides 126.

FIG. 13 shows another embodiment of the portion of the display apparatus that houses the light source. The primary difference between this embodiment and the previously discussed embodiment is that a light wheel 132 is located proximate the bulb 84. The light wheel 132 is a disk-shaped member having a plurality of different colored sections located in a side-by-side relation similar to a pie cut into triangular sections. The wheel is mounted on the end portion of a shaft 134. The shaft extends from an electrically-powered motor 136 that is connected to the same electrical source as bulb 84. When the motor is receiving power, it causes the light wheel to revolve. As the light wheel revolves, different colored sections of the wheel are brought into area 124 with the result that the light entering the bottom of member 88 will change color as each of the different colored sections of the light wheel become interposed between bulb 84 and the bottom of member of 88.

In operation, the invention shown in FIGS. 7–13 creates an optical illusion in which multiple virtual images 140 of member 88 are created and that seem to repeat rearwardly into infinity. As light enters the bottom of member 88 from bulb 84, the light travels upwardly through member 88 and exits predominantly from the side edges of the member. In this manner, the edges of the member are highly illuminated as if they themselves are a light source. This creates an appearance very similar to what would result if the member's side edges were in the form of neon tubes energized by a power source. However, since the light source is actually a conventional bulb 84 that is separate from member 88, this allows a user to replace one member 88 with another member 88 of a different shape to thereby create a similar illusion but based on the shape of the newly inserted member 88. This embodiment of the invention therefore enables a complexly-shaped light emitting surface (the body and/or side-edges of member 88) to be employed within the apparatus while only requiring a conventional and relatively inexpensive light bulb 84.

The preferred embodiments of the invention disclosed herein have been discussed for the purpose of familiarizing the reader with the novel aspects of the invention. Although preferred embodiments of the invention have been shown and described, many changes, modifications and substitutions may be made by one having ordinary skill in the art without necessarily departing from the spirit and scope of the invention as described in the following claims.

I claim:

1. A display apparatus comprising:

a housing;

a reflective/transparent member forming a face of said housing, wherein said member appears transparent from a point exterior to the housing and is at least partially reflective to light coming from within said housing;

a reflective member located within the housing and that functions to reflect light;

a first interior area located within said housing and between said reflective/transparent member and said reflective member;

a light source located in a second interior area within said housing; and a shaped member located at least partially in said first interior area, wherein said shaped member has a portion that is illuminated by said light source and wherein said shaped member provides the sole means for transmission of light from the light source to the first interior area whereby light from said light source can travel within said shaped member and cause at least a portion of said shaped member located within the first interior area to glow with light and wherein a plurality of images of at least a portion of said shaped member will be created within the first interior area of said housing as light issuing from said shaped member is reflected back and fourth between said reflective/transparent member and said reflective member.

2. The display apparatus of claim 1 wherein a separator member separates the first interior area of the housing from the second interior area of the housing, and wherein the separator member includes an aperture into which a portion of said shaped member is received and is thereby exposed to light from said light source.

3. The display apparatus of claim 2 further comprising a fastening means proximate said aperture that functions to secure the shaped member to the housing.

4. The display apparatus of claim 3 wherein the fastening means is a releasable fastening means whereby a user can remove the shaped member from said aperture and substitute another shaped member in its place.

5. The display apparatus of claim 1 wherein the light source comprises a fluorescent bulb electrically connected to a source of electricity.

6. The display apparatus of claim 1 wherein the shaped member is made of a translucent material.

7. The display apparatus of claim 1 wherein the shaped member is made of a transparent material.

8. The display apparatus of claim 1 wherein when the shaped member is exposed to light from said light source, first and second portions of said shaped member will emit light into said first interior area of said housing at different intensities, and wherein both of said portions can be viewed from a point exterior to the housing via the reflective/transparent member.

9. The display apparatus of claim 1 wherein a reflector at least partially surrounds the light source.

10. The display apparatus of claim 1 further comprising color changing means that changes the color of light that impinges on the shaped member from the light source.

11. The display apparatus of claim 10 wherein the color changing means comprises a colored, substantially transparent member that can be interposed between the light source and the shaped member.

12. The display apparatus of claim 11 wherein the housing includes an opening through which the colored, substantially transparent member can be inserted and thereby positioned between the light source and the shaped member.

13. The display apparatus of claim 11 wherein a plurality of colored, substantially transparent members are located on a common wheel-shaped member and wherein a motor means is secured to said housing and functions to rotate the wheel-shaped member.

14. The display apparatus of claim 1 wherein the shaped member is made of a plastic material.

15. The display apparatus of claim 1 wherein a first pattern means is located on a first surface of the shaped member.

16. The display apparatus of claim 15 wherein a second pattern means is located on a second surface of the shaped member.

17. A display apparatus comprising:

a hollow housing;

a reflective/transparent member secured to said housing and forming a face of said housing, wherein said member appears substantially transparent from a point exterior to the housing and is at least partially reflective to light coming from within said housing that is directed at a rear surface of said member;

a reflective member located within said housing;

an interior area located between said reflective/transparent member and said reflective member, and wherein light within said interior area can be reflected back and forth between said reflective/transparent member and said reflective member;

a shaped member made of a material that is capable of transmitting light, wherein a first portion of said shaped member has side edges and is located in said interior area between said reflective/transparent member and said reflective member, and wherein the side edges of the first portion of said member are discernible from a point exterior to the housing via the reflective/transparent member;

a light source within said housing in a location substantially isolated from said interior area; and wherein a portion of the shaped member is located so that it can be exposed to light from said light source whereby said light will travel within the shaped member and thereby cause the side edges of the member to glow with light as light exits from said member, and wherein light from said light source can only travel to said interior area by first traveling through the shaped member.

18. The apparatus of claim 17 further comprising color changing means that functions to change the color of the light that impinges on the shaped member from the light source.

* * * * *